US008130992B2

(12) United States Patent
Munk et al.

(10) Patent No.: US 8,130,992 B2
(45) Date of Patent: Mar. 6, 2012

(54) HEARING AID WITH ANTI-FEEDBACK

(75) Inventors: Steen Michael Munk, Smørum (DK); Karsten Bo Rasmussen, Smørum (DK)

(73) Assignee: Oticon A/S, Smorum (DK)

( * ) Notice: Subject to any disclaimer, the term of this patent is extended or adjusted under 35 U.S.C. 154(b) by 896 days.

(21) Appl. No.: 12/219,454

(22) Filed: Jul. 22, 2008

(65) Prior Publication Data

US 2009/0052708 A1 Feb. 26, 2009

(30) Foreign Application Priority Data

Aug. 24, 2007 (EP) ..... 07114933

(51) Int. Cl.
*H04R 25/00* (2006.01)

(52) U.S. Cl. ..... 381/318; 381/328; 381/93

(58) Field of Classification Search ..... 381/318, 381/328, 93

See application file for complete search history.

(56) References Cited

U.S. PATENT DOCUMENTS

| | | | | |
|---|---|---|---|---|
| 5,033,090 | A | 7/1991 | Weinrich | |
| 6,134,329 | A | 10/2000 | Gao et al. | |
| 2001/0002930 | A1 * | 6/2001 | Kates | 381/317 |
| 2002/0057814 | A1 | 5/2002 | Kaulberg | |
| 2004/0199380 | A1 | 10/2004 | Kandel et al. | |
| 2005/0094827 | A1 | 5/2005 | McDermott et al. | |
| 2006/0120545 | A1 * | 6/2006 | Rasmussen | 381/312 |

FOREIGN PATENT DOCUMENTS

| | | | |
|---|---|---|---|
| EP | 1 154 673 | A | 11/2001 |
| EP | 1 708 544 | A1 | 10/2006 |
| WO | WO-2005/052911 | A | 6/2005 |

* cited by examiner

*Primary Examiner* — Tu-Tu Ho

(74) *Attorney, Agent, or Firm* — Birch, Stewart, Kolasch & Birch, LLP

(57) ABSTRACT

Disclosed is a hearing aid, where at least part of the hearing aid is adapted to be inserted into an ear canal of a user such that one end of the hearing aid and the tympanic membrane in the ear canal define a residual space of the ear canal, the hearing aid comprising an ambient space input transducer adapted to convert ambient sound to an electric sound signal, when the ambient sound reaches the ear of a user from an ambient space, a processor connected to said ambient space input transducer and adapted to process said electric sound signal, an output transducer connected to said processor and adapted to convert said processed electric sound signal to a sound pressure in the residual space of the ear canal, and wherein the hearing aid further comprises a residual space input transducer connected to said processor and arranged to predominantly receive said sound pressure in the residual space, and wherein the residual space input transducer is adapted to convert said sound pressure to an electric residual space signal for compensating acoustic feedback.

12 Claims, 1 Drawing Sheet

HEARING AID WITH ANTI-FEEDBACK

FIELD OF THE INVENTION

This invention generally relates to a hearing aid, such as a behind-the-ear (BTE), in-the-ear (ITE), completely-in-canal (CIC), receiver-in-the-ear (RITE) or another type of hearing aid.

BACKGROUND OF THE INVENTION

Hearing aids are generally placed at least partially in the ear canal of a user and have the function of amplifying ambient sound entering the ear from the ambient space to the user. A hearing aid is generally having a distal end and a proximal end, and when the distal end of the hearing aid is placed in the ear canal of a user, a residual space is formed between the distal end of the hearing aid and the tympanic membrane in the ear canal. A microphone is generally placed in the proximal end of the hearing aid, so that it is pointing towards the ambient space of the user, and a loudspeaker is generally placed in the distal end of the hearing aid to transmit sound signals from the microphone to the residual space in the ear canal and hence to the tympanic membrane.

Hearing aids are typically equipped with a vent adapted to enable sound pressure equalisation between the ambient space and the residual space. The vent may also prevent occlusion experienced by the user of the hearing aid, which occlusion is caused by enclosed sound waves conducted via the skull and head tissue to the residual space. The vent ensures that the enclosed pressure changes may be equalised with the pressure in the ambient space.

The acoustic properties of the vent may establish a positive feedback loop between the loudspeaker and the microphone. Acoustic feedback may limit the possible amplification level in hearing aids. This problem is accentuated by the use of open hearing aids, i.e. hearing aids with a large vent.

EP 1708544 and U.S. Pat. No. 6,134,329 disclose that a so-called Real-Ear-Measurement (REM) can be performed, when fitting a hearing aid to a user, where the acoustic properties of the vent are measured. First a hearing aid is placed in the ear canal of a user and then a probe-microphone is inserted in the residual space defined between the distal end of the hearing aid and the tympanic membrane of the user to estimate the sound pressure level at the tympanic membrane in the residual space during the fitting of the hearing aid to the user. But since the acoustic model parameters stored in the hearing aid can not be changed and the probe itself causes a change in the residual space and the insertion of the probe may cause leakage, the use of REM may lead to incorrect results, since this solution relates to a static correction.

Various prior art documents, e.g. US 2002/0057814 and US 2005/0094827, describe hearing aids where the acoustic feedback is countered by digital processing algorithms. These algorithms estimate the acoustic transfer function from the loudspeaker to the microphone and perform a partial cancelling of the feedback signal based on the microphone signal and on the estimated transfer function. The transfer function is the mathematical representation of the relation between the microphone (i.e. the input of the system) and the loudspeaker (i.e. the output of the system).

It remains a problem to compensate properly for acoustic feedback in hearing aids, because even when using digital processing algorithms it is not possible to fully account for changes in the acoustic environment of the user.

SUMMARY

It is an object of the present invention to provide a hearing aid and a method for the compensation of acoustic feedback in hearing aids.

Disclosed is a hearing aid having a proximal end and a distal end, where at least part of the hearing aid is adapted to be inserted into an ear canal of a user such that the distal end and the tympanic membrane in the ear canal define a residual space of the ear canal, the hearing aid comprising:

an ambient space input transducer adapted to convert ambient sound to an electric sound signal, when the ambient sound reaches the ear of a user from an ambient space, a processor connected to said ambient space input transducer and adapted to process said electric sound signal, an output transducer connected to said processor and adapted to convert said processed electric sound signal to a sound pressure in said residual space, and wherein the hearing aid further comprises a residual space input transducer connected to said processor and arranged to predominantly receive said sound pressure in said residual space, and wherein the residual space input transducer is adapted to convert said sound pressure to an electric residual space signal for compensating acoustic feedback.

The residual space input transducer may preferably be comprised in the distal end of the hearing aid to estimate the acoustic spectrum emitted by the output transducer in the residual space. Thus a better estimate of the feedback transfer function of the system is obtained, and consequently a better anti-feedback compensation is achieved during normal operation of the hearing aid, since this allows for an adaptation of the feedback compensation during normal operation of the hearing aid, e.g. a real-time adaptation of the feedback compensation.

According to one embodiment of the present invention the acoustic transfer function from the output transducer to the ambient space input transducer may be estimated as a product of two transfer functions. The first transfer function is from the output transducer to the sound pressure in the residual space, and the second transfer function is from the sound pressure in the residual space to the ambient space input transducer. The first transfer function may serve to identify the acoustic output from the output transducer and this may be done with a first time constant suitable for this purpose. The second transfer function may serve to identify the transmission through the vent and into the ambient space input transducer and this may be done with a second time constant if suitable. This approach employs that the acoustic spectrum emitted by the output transducer may be estimated separately by means of the residual space input transducer, which is not part of the ambient sound signal path in the hearing aid, and this enables the anti-feedback system to adapt to changes in the acoustic environment continuously. This may be done by running estimates of the two transfer functions—the estimates being based on the relevant time constants.

In one embodiment, the processor may be adapted to determine a first transfer function, defined between the processed electric sound signal from the ambient space input transducer and the electric residual space signal from the output transducer to determine changes in the residual space, and to determine a second transfer function defined between the electric residual space signal from the residual space input transducer and the electric sound signal from the ambient space input transducer to determine changes in the ambient space.

In one embodiment, the ambient space input transducer and the residual space input transducer may comprise respective microphones.

In one embodiment, the output transducer may comprise a loudspeaker.

In one embodiment the hearing aid may comprise a vent for sound pressure equalisation between the ambient space and the residual space.

The hearing aid may be selected from the group of hearing aids consisting of in-the-ear hearing aid, completely-in-the-canal hearing aid, behind-the-ear hearing aid and receiver-in-the-ear hearing aid.

In one embodiment of the hearing aid the residual space input transducer may not be part of an ambient space signal path between any ambient space input transducer adapted to convert ambient sound to an electric sound signal, when the ambient sound reaches the ear of a user from an ambient space, and the output transducer.

In one embodiment of the hearing aid the residual space input transducer may be arranged close to the distal end in contact with the residual space.

The present invention relates to different aspects including the hearing aid described above and in the following, and corresponding methods, devices, and/or product means, each yielding one or more of the benefits and advantages described in connection with the first mentioned aspect, and each having one or more embodiments corresponding to the embodiments described in connection with the first mentioned aspect and/or disclosed in the appended claims.

According to one aspect a method of compensating acoustic feedback in a hearing aid, wherein the hearing aid is comprising a proximal end and a distal end, where at least part of the hearing aid is adapted to be inserted into an ear canal of a user such that the distal end and the tympanic membrane in the ear canal define a residual space of the ear canal, the method comprising:

converting an ambient sound to an electric sound signal, when the ambient sound reaches the ear of the user from an ambient space, by an ambient space input transducer, converting said processed electric sound signal to a sound pressure in a residual space defined between the distal end of said hearing aid and said tympanic membrane of the user by an output transducer connected to said processor, detecting the sound pressure in the residual space by a residual space input transducer comprised in the hearing aid and adapted to predominantly receive said sound pressure in the residual space, converting said detected sound pressure to an electric residual space signal by the residual space input transducer, and compensating acoustic feedback in the electric sound signal based on the electric residual space signal.

In one embodiment the method may comprise compensating acoustic feedback by determining at least one anti-feedback processing time constant from a transfer function defined between the electric sound signal and the electric residual space signal by said processor.

In one embodiment the method may comprise compensating acoustic feedback by determining a first anti-feedback processing time constant from a first transfer function defined between said processed electric sound signal and said electric residual space signal by said processor and determining a second anti-feedback processing time constant from a second transfer function defined between said electric residual space signal and said electric sound signal by said processor.

BRIEF DESCRIPTION OF THE DRAWING

The above and/or additional objects, features and advantages of the present invention, will be further elucidated by the following illustrative and non-limiting detailed description of embodiments of the present invention, with reference to the appended drawing, wherein.

DETAILED DESCRIPTION

Figure 1:
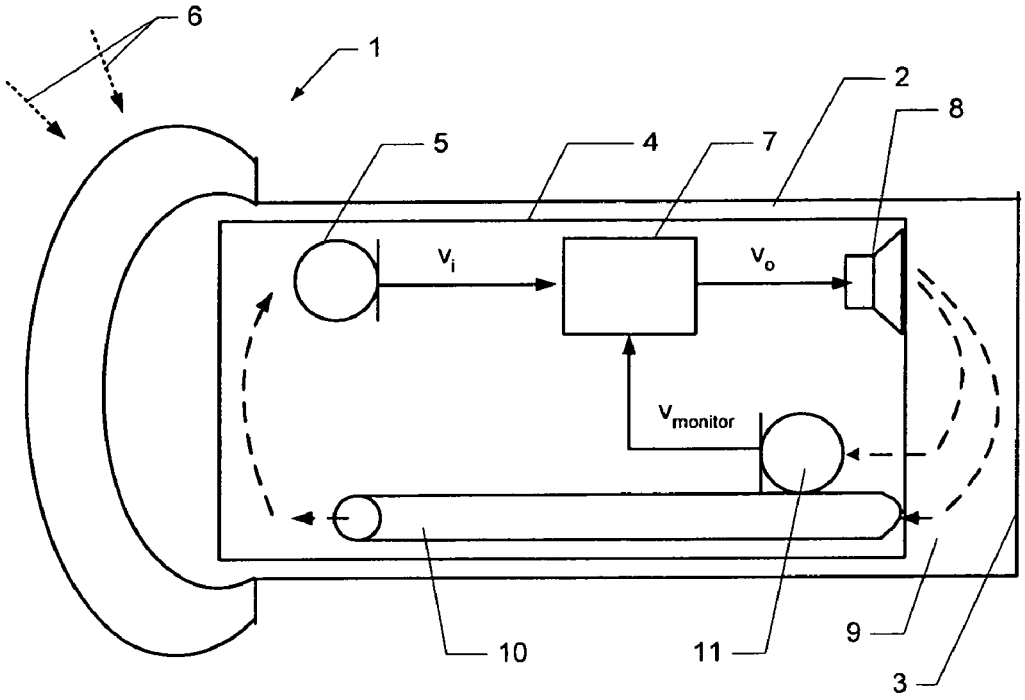
FIG. 1 shows a schematic view of a hearing aid inserted in a human ear.

In the following description, reference is made to the accompanying figures, which show by way of illustration how the invention may be practiced.

FIG. 1 shows a cross sectional view of an ear designated in entirety by reference numeral 1. The ear 1 comprises an outer section and an intermediate section with an ear canal 2 and a tympanic membrane 3.

A hearing aid designated in its entirety by reference numeral 4 is shown in FIG. 1 as positioned in the ear canal 2. The hearing aid 4 comprises an input transducer 5, e.g. a microphone, converting an ambient sound entering the ear from the ambient space, illustrated in FIG. 1 as punctuated arrows designated by reference numerals 6, to an electric sound signal. The electric sound signal is communicated to a signal processing unit 7 being adapted to process the electric sound signal in accordance with the estimated transfer function. It will be appreciated that in other embodiments, the input transducer 5 may be arranged outside the ear canal, e.g. behind the outer ear, i.e. the dorsal part of the ear.

In one embodiment the processor may comprise an input section, a filter section, an amplification section and a controller section adapted to control response of the filter section and the amplifier section to an incoming electric sound signal.

The electric sound signal is communicated to an output transducer 8, e.g. a loudspeaker. The output transducer 8 converts the electric sound signal to a sound pressure signal, which is communicated to the tympanic membrane 3 through a residual space 9 defined between the distal end of the hearing aid 4 and the tympanic membrane 3.

The sound pressure signal communicated from the output transducer 8 into the residual space 9 creates pressure changes in the residual space 9. These pressure changes may provide an occlusion effect for the user. In order to compensate for this effect the hearing aid 4 is equipped with a vent 10 equalising the pressure between the residual space 9 and the pressure in the ambient space.

The hearing aid 4 comprises a residual space input transducer 11 which monitors the sound pressure in the residual space 9, the sound pressure being emitted by the output transducer 8. This additional input transducer 11 is not part of the ambient space sound signal path in the hearing aid i.e. the sound signal path defined by the ambient space input transducer 5, the processor 7 and the output transducer 8, but is present for monitoring and control purposes. The residual space input transducer 11 generates an electric sound signal indicative of the received sound pressure from the residual space 9. The electric sound signal from the residual space input transducer 11 is fed into the processor 7.

The residual space input transducer 11 is arranged such that, during operation of the hearing aid, at least the majority of the sound pressure received by the residual space input transducer 11 originates from the residual space 9.

Since the sound pressure is detected separately by means of the residual space input transducer 11, the anti-feedback system is enabled to continuously adapt to changes in the acoustic environment and this leads to a better estimate of the feedback transfer function and hence to a better anti-feedback system.

The acoustic transfer function from the output transducer 8 to the ambient space input transducer 5 is estimated, by the processor 7, as a product of a first transfer function from the output transducer 8 to the sound pressure in the residual space 9, and a second transfer function from the sound pressure in the residual space 9 to the ambient space input transducer 5. The first transfer function serves to identify the acoustic output from the output transducer 8 and this may be done with a first time constant suitable for this purpose. The second transfer function serves to identify the transmission through the vent 10 and into the ambient space input transducer 5 and this may be done with a second time constant if suitable.

The transfer functions are estimated by relating $V_o$ to $V_{monitor}$ and $V_{monitor}$ to $V_i$. The time constants are used for denoting the speed of the adaptation. The product of the two transfer functions describes the overall acoustic feedback path which has to be estimated in order to reduce acoustic feedback in the hearing aid.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A hearing aid having a proximal end and a distal end, where at least part of the hearing aid is adapted to be inserted into an ear canal of a user such that the distal end and the tympanic membrane in the ear canal define a residual space of the ear canal, the hearing aid comprising:

an ambient space input transducer adapted to convert ambient sound to an electric sound signal, when the ambient sound reaches the ear of the user from an ambient space;

a processor connected to said ambient space input transducer and adapted to process said electric sound signal;

an output transducer connected to said processor and adapted to convert said processed electric sound signal to a sound pressure in said residual space; and a residual space input transducer connected to said processor and arranged to predominantly receive said sound pressure in the residual space, wherein the residual space input transducer is adapted to convert said sound pressure to an electric residual space signal for compensating acoustic feedback, and said processor is configured to determine a first anti-feedback transfer function defined between said processed electric sound signal and said electric residual space signal and determined using a first time constant, and to determine a second anti-feedback transfer function defined between said electric residual space signal and said electric sound signal using a second time constant.

2. The hearing aid according to claim 1, wherein the processor is configured to determine a third anti-feedback function defined between said processed electric sound signal and said electric sound signal as a product of said first anti-feedback transfer function and said second anti-feedback transfer function.

3. A hearing aid according to claim 1, wherein the ambient space input transducer and the residual space input transducer include respective microphones.

4. A hearing aid according to claim 1, wherein the output transducer comprises a loudspeaker.

5. A hearing aid according to claim 1 comprising a vent for sound pressure equalisation between the ambient space and the residual space.

6. A hearing aid according to claim 1, wherein the hearing aid is selected from the group of hearing aids consisting of in-the-ear hearing aid, completely-in-the-canal hearing aid, behind-the-ear hearing aid and receiver-in-the-ear hearing aid.

7. A hearing aid according to claim 1, wherein the processor comprises an input section, a filter section, an amplification section and a controller section adapted to control response of said filter section and said amplifier section to an incoming electric signal.

8. A hearing aid according to claim 1, wherein the residual space input transducer is not part of an ambient space signal path between any ambient space input transducer adapted to convert ambient sound to an electric sound signal, when the ambient sound reaches the ear of a user from an ambient space, and the output transducer.

9. A hearing aid according to claim 1, wherein the residual space input transducer is arranged closer to the distal end than to the proximal end of the hearing aid.

10. A method of compensating acoustic feedback in a hearing aid including a proximal end and a distal end, where at least part of the hearing aid is adapted to be inserted into an ear canal of a user such that the distal end and the tympanic membrane in the ear canal define a residual space of the ear canal, the method comprising:

converting an ambient sound to an electric sound signal, when the ambient sound reaches the ear of the user from an ambient space, by an ambient space input transducer;

processing said electric sound signal into a processed electric sound signal by a processor;

converting said processed electric sound signal to a sound pressure in a residual space defined between the distal end of said hearing aid and said tympanic membrane of the user by an output transducer connected to said processor;

detecting the sound pressure in the residual space by a residual space input transducer comprised in the hearing aid and adapted to predominantly receive said sound pressure in the residual space;

converting said detected sound pressure to an electric residual space signal by the residual space input transducer; and compensating acoustic feedback in the electric sound signal based on the electric residual space signal, the compensating including determining a first anti-feedback processing time constant from a first transfer function defined between said processed electric sound signal and said electric residual space signal by said processor, and determining a second anti-feedback processing time constant from a second transfer function defined between said electric residual space signal and said electric sound signal by said processor.

11. A method according to claim 10 comprising compensating acoustic feedback by determining at least one anti-feedback processing time constant from a transfer function defined between the electric sound signal and the electric residual space signal by said processor.

12. The method according to claim 10, further comprising:

determining a third anti-feedback function defined between said processed electric sound signal and said electric sound signal by multiplying said first anti-feedback transfer function and said second anti-feedback transfer function.

* * * * *